US009795823B2

(12) United States Patent
Wyncott

(10) Patent No.: US 9,795,823 B2
(45) Date of Patent: Oct. 24, 2017

(54) ADJUSTABLE WEIGHT KETTLEBELL

(71) Applicant: Ronald S Wyncott, Grayslake, IL (US)

(72) Inventor: Ronald S Wyncott, Grayslake, IL (US)

(73) Assignee: FITNESS FRIENDS, LLC, Grayslake, IL (US)

( * ) Notice: Subject to any disclaimer, the term of this patent is extended or adjusted under 35 U.S.C. 154(b) by 0 days.

(21) Appl. No.: 15/441,048

(22) Filed: Feb. 23, 2017

(65) Prior Publication Data

US 2017/0246495 A1 Aug. 31, 2017

Related U.S. Application Data

(60) Provisional application No. 62/299,596, filed on Feb. 25, 2016.

(51) Int. Cl.
*A63B 21/00* (2006.01)
*A63B 21/072* (2006.01)
(Continued)

(52) U.S. Cl.
CPC ..... *A63B 21/075* (2013.01); *A63B 21/00061* (2013.01); *A63B 21/00065* (2013.01);
(Continued)

(58) Field of Classification Search
CPC ..... A63B 21/0004; A63B 21/00058; A63B 21/00061; A63B 21/00065; A63B 21/00069; A63B 21/00072; A63B 21/00185; A63B 21/06; A63B 21/062; A63B 21/0622; A63B 21/0624; A63B 21/0626; A63B 21/0628; A63B 21/063; A63B 21/0632; A63B 21/072; A63B 21/0722; A63B 21/0724; A63B 21/0726; A63B 21/0728; A63B 21/075; A63B 21/08; A63B 21/15; A63B 21/159; A63B 21/4023; A63B 21/4033; A63B 21/4035; A63B 21/4043; A63B 21/4045;
(Continued)

(56) References Cited

U.S. PATENT DOCUMENTS 1,316,683 A * 9/1919 Calvert ..... A63B 21/072 473/125
D416,959 S * 11/1999 Tumminia ..... D21/662
(Continued)

*Primary Examiner* — Andrew S Lo
*Assistant Examiner* — Gary D Urbiel Goldner

(57) ABSTRACT

An adjustable weight kettlebell which allows a user to easily adjust the overall weight. The kettlebell includes a handle, a grasping hole, a central shaft, a locking mechanism, a stopper plate, a shaft-receiving tube, a locking collar, and an at least one weight plate. The grasping hole traverses through the handle. The shaft-receiving tube is perimetrically connected to the handle, perpendicular to the grasping hole. The central shaft is concentrically attached within the shaft-receiving tube by the locking mechanism, wherein the locking mechanism is mechanically integrated between the shaft-receiving tube and the central shaft. The central shaft retains and support the weight plate. The central shaft traverses through a mounting hole of the weight plate. The stopper plate is normally connected to the central shaft, opposite the handle, to retain the weight plate. The locking collar secures the weight plate in place and is slidably engaged to the central shaft.

7 Claims, 5 Drawing Sheets

(51) Int. Cl.
*A63B 21/075* (2006.01)
*A63B 23/12* (2006.01)

(52) U.S. Cl.
CPC ..... *A63B 21/0728* (2013.01); *A63B 21/4035* (2015.10); *A63B 23/12* (2013.01); *A63B 2209/00* (2013.01)

(58) Field of Classification Search
CPC . A63B 23/12; A63B 23/1209; A63B 23/1245; A63B 23/1281; A63B 23/14; A63B 23/16; A63B 2209/00; A63B 2225/09; A63B 2225/093
See application file for complete search history.

(56) References Cited

U.S. PATENT DOCUMENTS 7,563,208 B1 * 7/2009 Chen ..... A63B 21/075 482/108
7,731,640 B1 * 6/2010 Chen ..... A63B 21/0728 482/108
D653,715 S * 2/2012 Tumminia ..... D21/662
8,858,406 B2 * 10/2014 Klukas ..... A63B 15/00 482/108
2004/0162199 A1 * 8/2004 Connelly ..... A63B 21/0728 482/107
2007/0135274 A1 * 6/2007 Blateri ..... A63B 21/075 482/109
2008/0081744 A1 * 4/2008 Gormley ..... A63B 21/0728 482/93
2010/0190619 A1 * 7/2010 Chen ..... A63B 21/0728 482/108
2011/0306475 A1 * 12/2011 Caswell ..... A63B 21/0601 482/93
2012/0083391 A1 * 4/2012 Dooney ..... A63B 21/072 482/93
2014/0057764 A1 * 2/2014 Klukas ..... A63B 15/00 482/109
2014/0080683 A1 * 3/2014 Capobianco ..... A63B 21/0602 482/93
2014/0256522 A1 * 9/2014 Holt, IV ..... A63B 21/0602 482/110
2015/0011365 A1 * 1/2015 Nelson ..... A63B 69/205 482/84
2015/0031508 A1 * 1/2015 Goldberg ..... A63B 21/072 482/106
2015/0174445 A1 * 6/2015 Robertson, Jr. .... A63B 23/0405 482/93
2015/0231440 A1 * 8/2015 Nelson ..... A63B 21/075 482/108
2016/0144219 A1 * 5/2016 Koenig ..... A63B 21/075 482/93

* cited by examiner

ADJUSTABLE WEIGHT KETTLEBELL

The current application claims a priority to the U.S. Provisional Patent application Ser. No. 62/299,596 filed on Feb. 25, 2016.

FIELD OF THE INVENTION

The present invention relates generally to exercise equipment. More specifically, the present invention is an adjustable kettlebell that is compatible with a variety of different types and sizes of weight plates. For example, the present invention is compatible with standard and Olympic sized weight plates.

BACKGROUND OF THE INVENTION

A kettlebell is a great exercise tool to improve the posterior chain muscles. The kettlebell is a compact, sphere-shaped free weight with an attached handle that was developed in the 1700s. Originally developed for weighing crops in Russia, the kettlebell has grown in popularity within the modern fitness community. The compact and ergonomic shape of the kettlebell allows the user perform ballistic exercises which provides the user with cardiovascular, strength, and flexibility training. Ballistic exercises are a form of strength training that are defined by the user rapidly lifting, dropping, and in some instances releasing a weight. While kettlebells allow the user to perform a variety of different training routines, because the weight of a kettlebell cannot be adjusted, a user ultimately has to have an entire set of kettlebells on hand when they want to increase weight resistance.

It is therefore an object of the present invention to provide a kettlebell which allows a user to adjust the total weight to easily increase resistance. More specifically, the present invention is a customizable kettlebell which allows the user to vary the overall weight easily and efficiently. The present invention achieves this by being able to hold a multitude of traditional weight plates. The user simply removes or adds weight plates to the present invention in order to change the overall weight of the device. Additionally, the present invention is compatible with standard and Olympic sized weight plates, further decreasing the overall cost for the present invention.

DETAIL DESCRIPTIONS OF THE INVENTION

All illustrations of the drawings are for the purpose of describing selected versions of the present invention and are not intended to limit the scope of the present invention.

The present invention generally relates to exercise equipment. More specifically, the present invention is an alternative design for a kettlebell which allows a user to easily vary the total weight while keeping the ergonomic characteristics of a traditional kettlebell. One of the main benefits is that the present invention is compatible with a wide variety of weights. For example, the present invention is compatible with standard and Olympic style weights.

Figure 1:
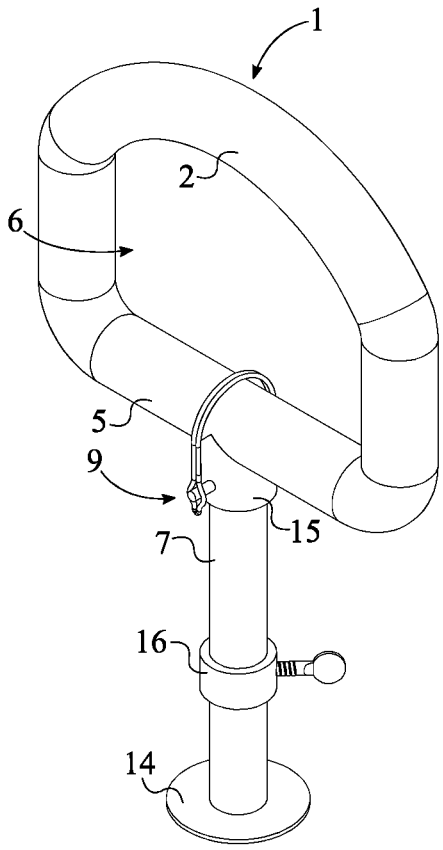
FIG. 1 is a perspective view of the present invention the weight plate(s) component omitted.
Figure 2:
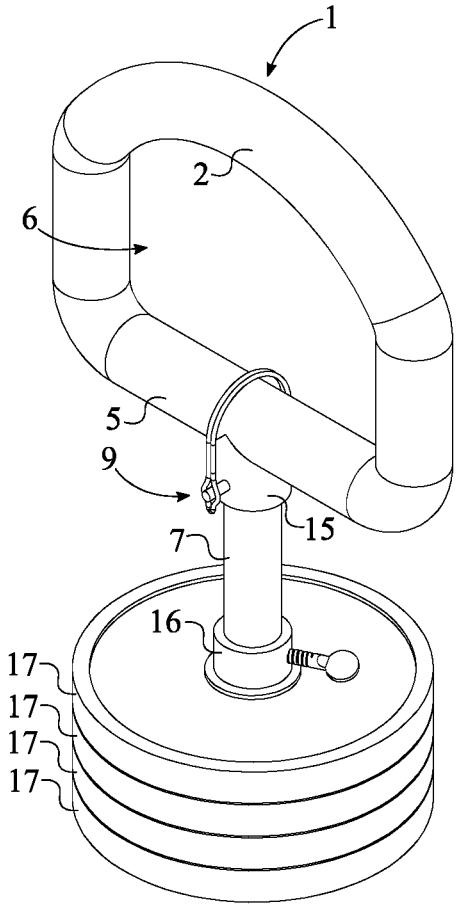
FIG. 2 is a perspective view of the present invention.
Figure 3:
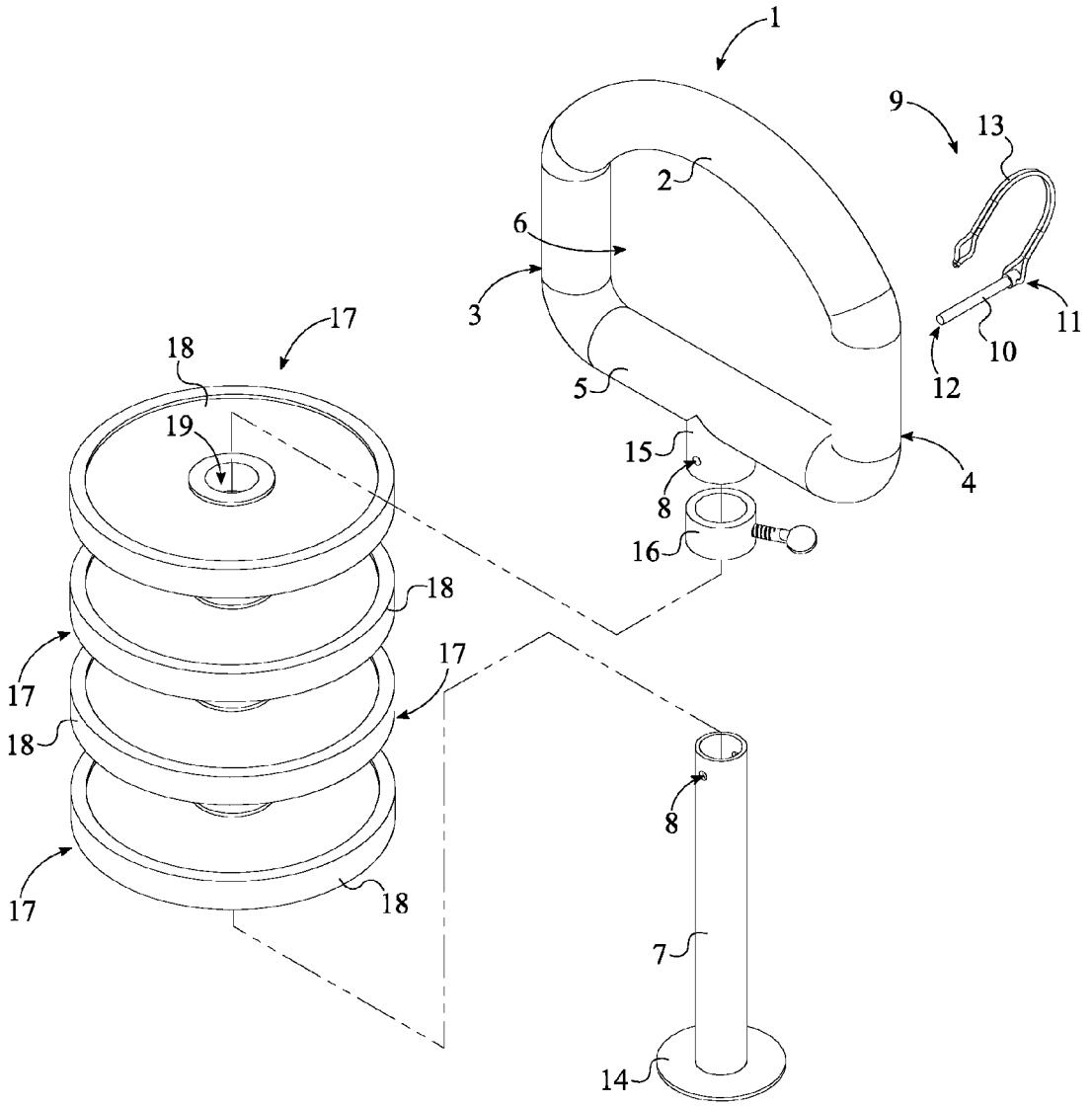
FIG. 3 is an exploded view of the present invention.

Referring to FIG. 1 and FIG. 2, the present invention comprises a handle 1, a grasping hole 6, a central shaft 7, an at least one weight plate 17, a locking mechanism 9, a stopper plate 14, a shaft-receiving tube 15, and a locking collar 16. The handle 1 acts as the grasping element for the present invention, allowing the user to grab and utilize the present invention. The grasping hole 6 laterally traverses through the handle 1 and allows the user to wrap all the fingers of his or her hand about the handle 1. The grasping hole 6 is preferably sized and shaped to receive the fingers of the user's hand, thus providing the user with a significantly strong grip over the handle 1 and thus the present invention. The grasping hole 6 allows the user to grasp the present invention with two hands as a variety of ballistic exercises for kettlebells require two hands. The grasping hole 6 in conjunction with the handle 1 allow for a comfortable and strong grip, an important characteristic when performing ballistic exercises that involve dynamic body and weight movement. The central shaft 7 acts as the mounting element for the at least one weight plate 17. The shaft-receiving tube 15 attaches the central shaft 7 to the handle 1 as seen in FIG. 3. More specifically, the shaft-receiving tube 15 is perimetrically connected to the handle 1, oriented perpendicular to the grasping hole 6. When grasped by the user, this configuration aligns the shaft-receiving tube 15 and thus the central shaft 7 along the length of the user's arm, similar to traditional kettlebell designs.

The central shaft 7 is concentrically positioned within the shaft-receiving tube 15, opposite the handle 1. The central shaft 7 is secured within the shaft-receiving tube 15 by the locking mechanism 9. In one embodiment of the present invention, the diameter of the central shaft 7 can be 1 and 1/16 inches or 1 and 15/16 inches; although, alternative diameters may be utilized in alternative embodiments of the present invention. The length of the central shaft 7 can come in a variety of sizes including, but not limited to, 7⅝, 5 and ⅝ inches, 9 inches, or 11 inches. The locking mechanism 9 is mechanically integrated in between the central shaft 7 and the shaft-receiving tube 15. Thus, the central shaft 7 is attached to the shaft-receiving tube 15 by the locking mechanism 9. A variety of mechanisms and devices may be used as the locking mechanism 9 including, but not limited to, pins, clamps, collars, and other similar technologies.

The stopper plate 14 is a disk-shaped structure which vertically supports the weight plate(s) 17. More specifically, the stopper plate 14 is positioned adjacent to the central shaft 7, opposite shaft-receiving tube 15 and is connected normal to the central shaft 7. Additionally, the stopper plate 14 is used as a resting structure during storage or in between workouts. The at least one weight plate 17 allows the user to vary the overall weight of the present invention, thus increasing or decreasing the resistance for his or her workout routine. The weight plate 17 comprises a planar body 18 and a mounting hole 19. The planar body 18 is preferably a disk-shaped and composed of a heavy metal with a specific weight. The mounting hole 19 normally and centrally traverses through the planar body 18. The mounting hole 19 is sized to the shape and size of the central shaft 7 in order to facilitate an interlocking fit. When the weight plate 17 is mounted on the central shaft 7, the planar body 18 is positioned in between the stopper plate 14 and the shaft-receiving tube 15, parallel to the stopper plate 14. The central shaft 7 traverses through the mounting hole 19 and thus retains the weight plate 17. During exercise, the locking collar 16 secures the weight plate 17 and prevents the weight plate 17 from sliding up and down the central shaft 7. Referring to FIG. 1, the locking collar 16 is positioned in between the stopper plate 14 and the shaft-receiving tube 15. Additionally, the locking collar 16 is slidably engaged along the central shaft 7. When tightened in place, the locking collar 16 and the stopper plate 14 sandwich and secure the weight plate 17 on the central shaft 7. The size and shape of the planar body 18 are subject to change in order to meet the needs and preferences of the user.

Referring to FIG. 3, in the preferred embodiment, the present invention further comprises a pin-receiving hole 8 and the locking mechanism 9 is a snapper pin. More specifically, the snapper pin comprises a locking pin 10 and a retainer wire 13. The pin-receiving hole 8 traverses through the shaft-receiving tube 15 and the central shaft 7. The pin-receiving hole 8 is sized and shaped to compliment the shape and dimensions of the locking pin 10. The locking pin 10 is positioned within the pin-receiving hole 8 in order to mechanically join the central shaft 7 and the shaft-receiving tube 15, and thus the handle 1. The retainer wire 13 secures the locking pin 10 within the pin-receiving hole 8 and prevents the locking pin 10 from accidental disengagement. The retainer wire 13 is attached to the locking pin 10 in between a first end 11 of the locking pin 10 and a second end 12 of the locking pin 10. Additionally, the retainer wire 13 is externally positioned to the shaft-receiving tube 15; the retainer wire 13 traverses through the grasping hole 6 to be more specific. The retainer wire 13 includes a looped end which engaged the locking pin 10 in order to lock the mechanism. More specifically, the retainer wire 13 is rotatably connected to the first end 11 of the locking pin 10 and mechanically engaged to the second end 12 of the locking pin 10 by the looped end of the retainer wire 13. The retainer wire 13 is composed of a rigid metal material in order to allow for minor deformation with adequate strength for extended use. In order to unlock the snapper pin, the user simply pulls and disengages the looped end of the retainer wire 13 from the locking pin 10 and removes the locking pin 10. This disengages the central shaft 7 from the shaft-receiving tube 15 and thus allows the user to add or remove weight plates 17 according to his or her preference. Once the total weight is satisfactory to the user, the user simple inserts the locking pin 10 into the pin-receiving hole 8 and snaps the looped end of the retainer wire 13 over the second end 12 of the locking pin 10.

Referring to FIG. 3, the handle 1 comprises a U-shaped loop 2 and a handle body 5. The U-shaped loop 2 is a cylindrical structure bent into a U-shape. The U-shaped loop 2 acts as the grasping element for the user's hand(s). Preferably, the U-shaped loop 2 is a cylindrical structure with a diameter of 2.5 inches as this allows smaller hands to easily grasp the U-shaped loop 2; although alternative shapes and diameters may also be used. The handle body 5 is an elongated cylinder that is connected in between a first end 3 of the U-shaped loop 2 and a second end 4 of the U-shaped loop 2 to yield a rigid structure. More specifically, the first end 3 of the U-shaped loop 2 is adjacently connected to the handle body 5. The second end 4 of the U-shaped loop 2 is positioned opposite the first end 3 of the U-shaped loop 2 across the handle body 5; and the second end 4 of the U-shaped loop 2 is adjacently connected to the handle body 5. Resultantly, the U-shaped loop 2 and the handle body 5 delineate the grasping hole 6 as seen in FIG. 3. The size, material composition, cross-section geometry, and other characteristics of the U-shaped loop 2 and the handle body 5 may vary in order to meet the needs and the preferences of the user.

Figure 4:
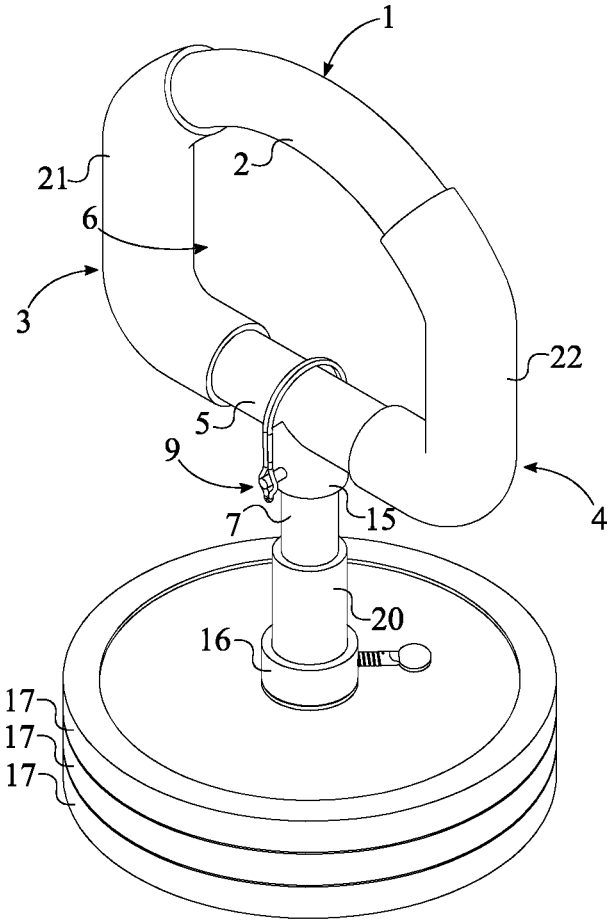
FIG. 4 is a perspective view of an alternative embodiment of the present invention.

Referring to FIG. 4, in order to ensure that the present invention does not accidentally slip out of the user's grasp, the present invention further comprises a first grip sleeve 21 and a second grip sleeve 22. The first grip sleeve 21 and the second grip sleeve 22 are each composed of a highly-textured material. For example, in one embodiment, the first grip sleeve 21 and the second grip sleeve 22 are each composed of carbon fiber. The carbon fiber provides a surface with a gripping texture and structurally supports the material/components that it is wrapped around. The first grip sleeve 21 and the second grip sleeve 22 are positioned opposite to each other across the handle body 5. More specifically, the first grip sleeve 21 is connected about the connection between the U-shaped loop 2 and the handle body 5. Similarly, the second grip sleeve 22 is connected about the connection between the U-shaped loop 2 and the handle body 5. Both, the first grip sleeve 21 and the second grip sleeve 22 partially extent along the U-shaped loop 2 and the handle body 5. This provides the user with a gripping surface on the majority of the handle 1.

The first grip sleeve 21 and the second grip sleeve 22 allow the user to grasp the U-shaped loop 2 laterally and perform various exercises resultantly. The first grip sleeve 21 and the second grip sleeve 22 ensure that the user has a significant grip over the handle 1 and prevent the handle 1 from sliding, rotating, and translating within the grasp of the user. Although, for some traditional ballistic exercises, it is important that the handle 1 may rotate within the hand of the user. One example is the kettlebell swing where the user swings the kettlebell from the legs region to the head region; for this exercise the kettlebell, and the present invention, must be able to partially rotate within the grasp of the user. The present invention accounts for these types of exercise by constructing the U-shaped loop 2 out of polyvinyl chloride (PVC). PVC composed components is characterized by a smooth external surface, thus allowing for partial movement and rotation within the grasp of the user. The exposed portion of the U-shaped loop 2 in between the first grip sleeve 21 and the second grip sleeve 22 provides the user with a smooth engagement surface as seen in FIG. 4.

Figure 5:
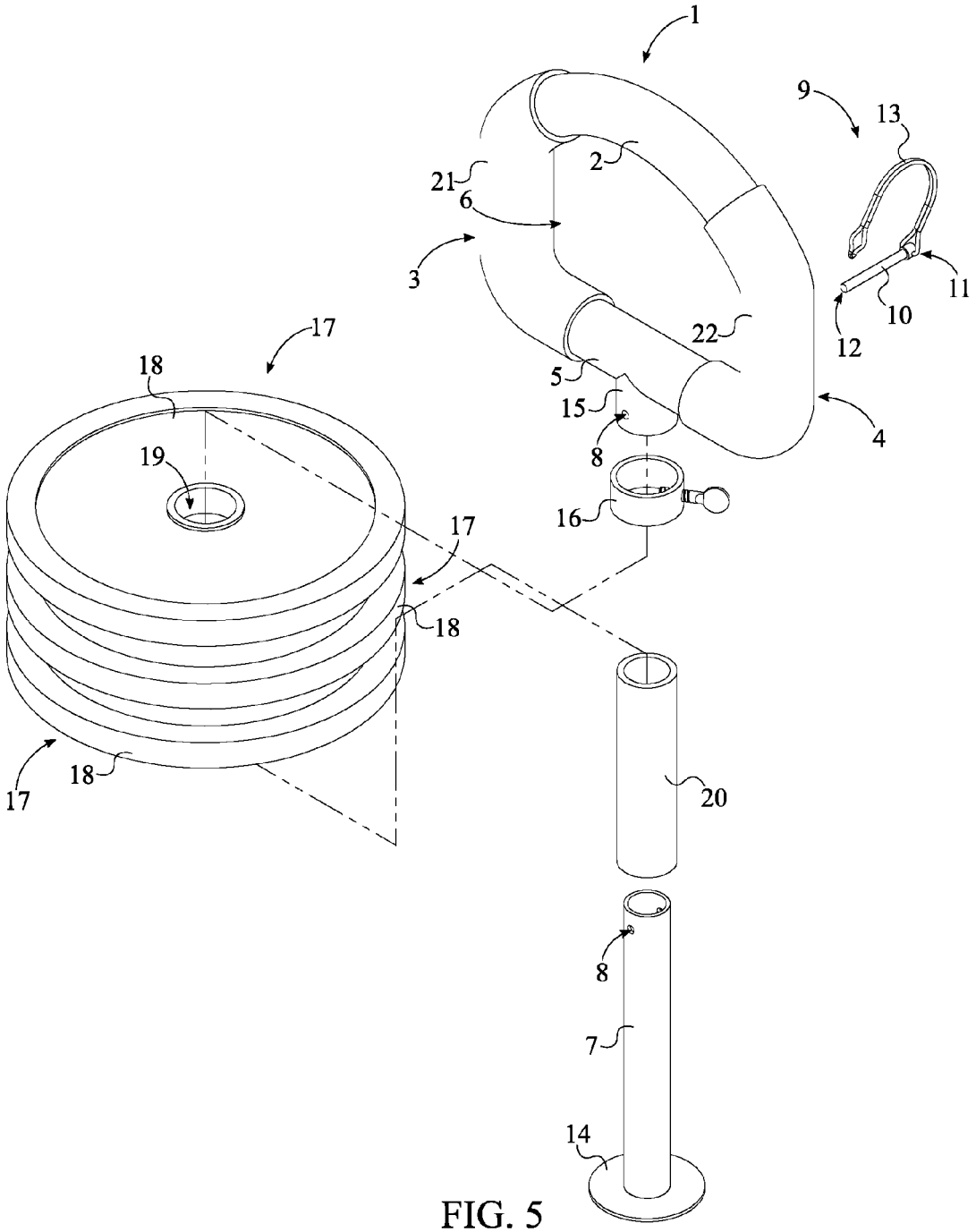
FIG. 5 is an exploded view of the alternative embodiment of the present invention.

Referring to FIG. 5, in the preferred embodiment of the present invention, the weight plate 17 may be either a standard size or an Olympic size. One of the main advantages of the present invention is that the present invention is compatible with a wide variety of types of weights available on the modern market. The central shaft 7 is designed to receive and compliment a standard size weight plate 17. In order for the present invention to hold an Olympic size weight plate 17, a spacer adaptor 20 is used. The spacer adaptor 20 is positioned in between the shaft-receiving tube 15 and the stopper plate 14 with the central shaft 7 being sleeved by the spacer adaptor 20. The outer diameter of the spacer adaptor 20 is equal to the mounting hole 19 of the Olympic size weight plate 17. As such, the spacer adaptor 20 traverses through the mounting hole 19 of the weight plate 17 and the through the locking collar 16. The spacer adaptor 20 is secured in place through a pair of screws. The pair of screws laterally traverse through the spacer adaptor 20 and when tightened apply a locking force on the central shaft 7 in order to secure the spacer adaptor 20 in place.

Although the invention has been explained in relation to its preferred embodiment, it is to be understood that many other possible modifications and variations can be made without departing from the spirit and scope of the invention as hereinafter claimed.

What is claimed is:

1. An adjustable weight kettlebell comprising:

a handle;

a grasping hole;

a central shaft;

a locking mechanism;

a stopper plate;

a shaft-receiving tube;

a locking collar;

a pin-receiving hole;

the grasping hole laterally traversing through the handle;

the shaft-receiving tube being perimetrically connected to the handle; the shaft-receiving tube having a central longitudinal axis; the central shaft being concentrically positioned within the shaft-receiving tube, opposite the handle, wherein the central longitudinal axis of the shaft-receiving tube is oriented along a length of the central shaft and substantially coplanar with the handle the locking mechanism being mechanically integrated in between the central shaft and the shaft-receiving tube;

the central shaft being attached to the shaft-receiving tube by the locking mechanism;

the stopper plate being positioned adjacent to the central shaft, opposite the shaft-receiving tube;

the stopper plate being connected normal to the central shaft;

the locking collar being positioned in between the stopper plate and the shaft-receiving tube;

the locking collar being slidably engaged along the central shaft;

the locking mechanism being a snapper pin;

the snapper pin comprising a locking pin and a retainer wire;

the pin-receiving hole laterally traversing through the shaft-receiving tube and the central shaft;

the locking pin being positioned within the pin-receiving hole;

the retainer wire comprising a first looped end and a second looped end;

the first looped end and the second looped end being located opposite to each other along the retainer wire;

the locking pin comprising a first end and a second end;

the first end and the second end being located opposite to each other along the locking pin;

the first looped end of the retainer wire being rotatably connected with the first end of the locking pin;

the second looped end of the retainer wire removably encircling the locking pin in between the first end of the locking pin and the second end of the locking pin; and the retainer wire being externally positioned to the shaft-receiving tube.

2. The adjustable weight kettlebell as claimed in claim 1 comprising:

the retainer wire traversing through the grasping hole.

3. The adjustable weight kettlebell as claimed in claim 1 comprising:

at least one weight plate;

the weight plate comprising a planar body and a mounting hole;

the mounting hole normally and centrally traversing through the planar body;

the planar body being positioned in between the stopper plate and the shaft-receiving tube, parallel to the stopper plate; and the central shaft traversing through the mounting hole.

4. The adjustable weight kettlebell as claimed in claim 3 comprising:

a spacer adaptor;

the spacer adaptor being positioned in between the shaft-receiving tube and the stopper plate;

the central shaft being sleeved by the spacer adaptor;

the spacer adaptor traversing through the mounting hole of the weight plate; and the spacer adaptor traversing through the locking collar.

5. The adjustable weight kettlebell as claimed in claim 1 comprising:

the handle comprising a U-shaped loop and a handle body;

a first end of the U-shaped loop being adjacently connected to the handle body;

a second end of the U-shaped loop being positioned opposite the first end of the U-shaped loop, across the handle body;

the second end of the U-shaped loop being adjacently connected to the handle body; and the handle body and the U-shaped loop delineating the grasping hole.

6. The adjustable weight kettlebell as claimed in claim 5 comprising:

a first grip sleeve;

a second grip sleeve;

the first grip sleeve and the second grip sleeve being positioned opposite to each other across the handle body;

the first grip sleeve being connected about the connection between the U-shaped loop and the handle body; and the second grip sleeve being connected about the connection between the U-shaped loop and the handle body.

7. The adjustable weight kettlebell as claimed in claim 5 comprising:

the U-shaped loop being composed of polyvinyl chloride (PVC).

* * * * *